US005923256A

United States Patent [19]

Satake et al.

[11] Patent Number: 5,923,256

[45] Date of Patent: Jul. 13, 1999

[54] DRIVER DOZING PREVENTION SYSTEM WITH MOVING ALARM SOUND

[75] Inventors: Toshihide Satake; Mitsuo Shimotani; Minoru Nishida; Makito Seki, all of Tokyo, Japan

[73] Assignee: Mitsubishi Denki Kabushiki Kaisha, Tokyo, Japan

[21] Appl. No.: 08/957,021

[22] Filed: Oct. 24, 1997

[30] Foreign Application Priority Data

May 15, 1997 [JP] Japan ..... 9-125609

[51] Int. Cl.[6] ..... G08B 21/00; G08B 03/10

[52] U.S. Cl. ..... 340/575; 340/576; 340/691.1; 340/692

[58] Field of Search ..... 340/576, 575, 340/692, 691.1, 691.2

[56] References Cited

U.S. PATENT DOCUMENTS

| | | | |
|---|---|---|---|
| 4,571,583 | 2/1986 | Giordano | 340/691.2 |
| 5,684,455 | 11/1997 | Williams et al. | 340/576 |
| 5,684,462 | 11/1997 | Gold | 340/576 |
| 5,745,038 | 4/1998 | Vance | 340/576 |
| 5,786,760 | 7/1998 | Suzuki et al. | 340/691.1 |

FOREIGN PATENT DOCUMENTS

| | | |
|---|---|---|
| 6-219181 | 8/1994 | Japan . |
| 6-270711 | 9/1994 | Japan . |

*Primary Examiner*—Glen Swann
*Attorney, Agent, or Firm*—Sughrue, Mion, Zinn, Macpeak & Seas, PLLC

[57] ABSTRACT

A driver dozing preventing apparatus includes a device for issuing a doze prevention alarm signal, and a device for outputting an alarm sound having a moving acoustic image of a fundamental sound when the alarm signal is issued.

12 Claims, 8 Drawing Sheets

DRIVER DOZING PREVENTION SYSTEM WITH MOVING ALARM SOUND

BACKGROUND OF THE INVENTION

1. Field of the Invention

The present invention relates to a driver dozing preventing apparatus for preventing drivers from dozing, and particularly to an alarm output device for outputting an alarm when a driver's doze is detected.

2. Description of the Prior Art

A conventional driver dozing preventing apparatus detects a signal indicative of a vehicle behavior such as a steering angle or the like, and signals indicative of driver's physiological changes such as blinking, brain waves, skin potential activity, etc., to thereby determine a reduction in the degree of driver's awakening or wakefulness and produce or issue an alarm when it determines that the degree of driver's wakefulness has been reduced.

An apparatus for determining based on blinking whether the degree of driver's wakefulness is reduced and outputting an alarm when it is determined that the degree of driver's wakefulness has been reduced, has been described in JP-A Nos. 6-219181 and 6-270711, for example.

FIG. 14 is a block diagram showing the structure of the conventional driver dozing preventing apparatus disclosed in JP-A No. 6-270711. In the drawing, reference numeral 10 indicates an opened/closed eyes detecting means for detecting whether the driver's eyes are in an opened or closed state. Reference numeral 20 indicates a closed-eyes duration measuring means for measuring the duration of the state of the closed eyes when the driver is in the closed-eyes state. Reference numeral 30 indicates a characteristic amount calculating means for calculating a feature or characteristic amount for characterizing the degree of driver's wakefulness. Reference numeral 40 indicates a determining means for determining, based on the characteristic amount calculated from the characteristic amount calculating means 30, whether the driver is being awakened. Reference numeral 50 indicates a warning means for producing an alarm when the determining means 40 determines or judges the driver as being in the wakefulness-reduced state.

The operation of the driver dozing preventing apparatus shown in FIG. 14 will next be described. The opened/closed eyes detecting means 10 detects whether the driver's eyes are open or close. When the opened/closed eyes detecting means 10 detects that the driver's eyes are closed, the closed-eyes duration measuring means 20 measures a closed-eyes lasting time during which the closed-eyes state continues.

Further, the characteristic amount calculating means 30 calculates an accumulated or integrated value of the closed-eyes duration corresponding to the amount of characteristic for characterizing the degree of driver's wakefulness, based on the value measured by the closed-eyes duration measuring means 20. Based on the calculated characteristic amount, the determining means 40 makes a decision as to whether the driver is being awakened. When the integrated value per predetermined time (one minute in the present apparatus) is greater than a predetermined quantity (10 seconds in the present apparatus) in this case, the determining means 40 judges the driver as being in the wakefulness-reduced state. When the determining means 40 determines that the driver is in the wakefulness-reduced state, the warning means 50 outputs an alarm.

The conventional driver dozing preventing apparatus is accompanied by a problem that since an alarm sound outputted when the degree of driver's wakefulness is judged as low, is monotonous, the driver becomes accustomed to the output alarm sound if the alarm sound is repeatedly outputted over a long time, so that the apparatus cannot achieve the function of preventing dozed driving.

SUMMARY OF THE INVENTION

With the foregoing in view, it is therefore an object of the present invention to provide a driver dozing preventing apparatus for outputting an alarm sound in which an acoustic image of a fundamental sound moves, when the degree of driver's wakefulness is judged as being reduced, thereby making it possible to prevent the dozing of a driver for hours without the driver being accustomed to the alarm sound.

According to a first aspect of the present invention, for achieving the above object, there is provided a driver dozing preventing apparatus comprising:

means for issuing a doze prevention alarm signal; and means for outputting an alarm sound in which an acoustic image of a fundamental sound moves, when the alarm signal is issued from the issuing means. Thus, an advantageous effect can be brought about in that a great psychological or mental change can be given to the driver and hence the driver can be prevented for hours from dozing.

According to a second aspect of the present invention, there is provided a driver dozing preventing apparatus wherein the issuing means issues a doze preventive alarm signal when a degree of driver's wakefulness has been reduced. Thus, an advantageous effect can be brought about in that when the degree of driver's wakefulness is reduced, a doze preventive alarm can be reliably issued.

According to a third aspect of the present invention, there is provided a driver dozing preventing apparatus wherein the alarm sound includes a plurality of moving acoustic images. Thus, an advantageous effect can be brought about in that a greater mental change can be given to a driver as compared with an alarm sound in which a single acoustic image moves.

According to a fourth aspect of the present invention, there is provided a driver dozing preventing apparatus wherein the alarm sound is selected from an available plurality of alarm sounds. Thus, an advantageous effect can be brought about in that an object is not accustomed to an alarm sound and hence the object can be prevented for hours from dozing.

According to a fifth aspect of the present invention, there is provided a driver dozing preventing apparatus wherein the alarm sound is selected from an available alarm sound having a first fundamental sound and an available alarm sound having a second fundamental sound different from the first fundamental sound. Thus, an advantageous effect can be brought about in that alarm sounds having different fundamental sounds can be outputted and hence a greater mental change can be given to a driver.

According to a sixth aspect of the present invention, there is provided a driver dozing preventing apparatus wherein the alarm sound is selected from an available alarm sound having a first transfer mode of an acoustic image and an alarm sound candidate having a second transfer mode of an acoustic image, which is different from the first transfer mode. Thus, an advantageous effect can be brought about in that alarm sounds having different transfer modes can be outputted and hence a greater mental change can be given to a driver.

According to a seventh aspect of the present invention, there is provided a driver dozing preventing apparatus wherein the outputting means outputs the alarm sound plural times. Thus, an advantageous effect can be brought about in that the type of alarm sound can be changed and hence a greater mental change can be given to a driver.

According to an eighth aspect of the present invention, there is provided a driver dozing preventing apparatus wherein the outputting means outputs a second alarm sound different from a first alarm sound after the first alarm sound has been outputted. Thus, an advantageous effect can be brought about in that a driver is not accustomed to an alarm sound and hence the driver can be prevented for hours from dozing.

According to a ninth aspect of the present invention, there is provided a driver dozing preventing apparatus wherein the first or second alarm sound is an alarm sound having a fixed acoustic image. Thus, an advantageous effect can be brought about in that an alarm sound whose acoustic image moves and an alarm sound free from the movement of an acoustic image can be outputted and hence a driver is not accustomed to each alarm sound, thereby making it possible to prevent the dozing of the driver for hours.

According to a tenth aspect of the present invention, there is provided a driver dozing preventing apparatus wherein a time interval of a first alarm sound output by the outputting means differs from a time interval of a second alarm sound output by the outputting means. Thus, an advantageous effect can be brought about in that a driver cannot expect the cycle of an alarm output and hence a greater mental change can be given to the driver, thereby making it possible to prevent the dozing of the driver for hours.

According to an eleventh aspect of the present invention, there is provided a driver dozing preventing apparatus wherein time intervals between adjacent alarm sounds are different from each other. Thus, an advantageous effect can be brought about in that a driver cannot expect timing provided to output an alarm and hence an alarm for giving a greater mental change to the driver can be produced, thereby making it possible to prevent the dozing of the driver for hours.

According to a twelfth aspect of the present invention, there is provided driver dozing preventing apparatus wherein the outputting means outputs at least one of vibrations, odors and cold air. Thus, an advantageous effect can be brought about in that since a driver hears an alarm through one other than acoustic sense thereof as well as through the acoustic sense, an alarm for giving a greater mental change to the driver can be produced, thereby making it possible to prevent the dozing of the driver for hours.

BRIEF DESCRIPTION OF THE DRAWINGS

Other objects and advantages of the present invention will be more completely understood from the following detailed description, taken in conjunction with the accompanying drawings wherein.

DETAILED DESCRIPTION OF THE PREFERRED EMBODIMENTS

Preferred embodiments of the present invention will hereinafter be described in detail with reference to the accompanying drawings.

First Embodiment

Figure 1:
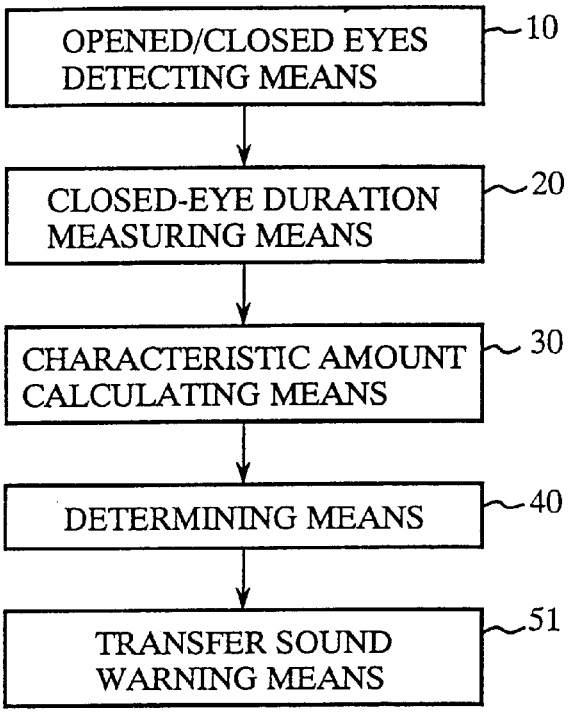
FIG. 1 is a block diagram showing a driver dozing preventing apparatus according to a first embodiment of the present invention.

FIG. 1 is a diagram showing the structure of a driver dozing preventing apparatus according to a first embodiment of the present invention. In the drawing, reference numeral 10 indicates an opened/closed eyes detecting means for detecting whether driver's eyes are in an open or a closed state. Reference numeral 20 indicates a closed-eyes duration measuring means for measuring the duration of the closed state of eyes when the driver's eyes are in the closed state. Reference numeral 30 indicates a characteristic amount calculating means for calculating a feature amount for characterizing the degree of driver's awakening or wakefulness. Reference numeral 40 indicates an alarm signal producing means for giving an alarm to a driver, which is means for determining, based on the amount of characteristic calculated from the characteristic amount calculating means 30, whether the driver is being awakened. Reference numeral 51 indicates a transfer sound warning means for outputting a transfer sound alarm when the determining means 40 has determined that the driver is in a wakefulness-reduced state.

Figure 2:
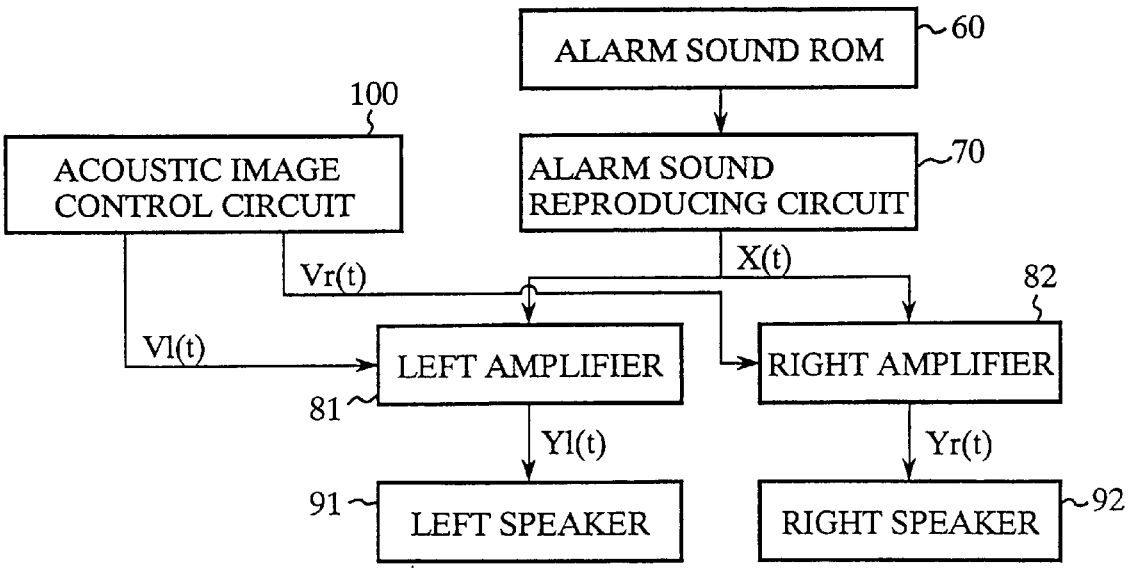
FIG. 2 is a block diagram illustrating a transfer sound warning means employed in the first embodiment shown in FIG. 1.

FIG. 2 is a block diagram showing one example of the structure of the transfer sound warning means 51 shown in FIG. 1. In the drawing, reference numeral 60 indicates an alarm sound ROM with the original or fundamental sound or tone stored therein. For example, data about an alarm sound having a time length ranging from about 15 to 30 seconds has been stored in the RON 60. Reference numeral 70 indicates an alarm sound reproducing circuit for reproducing the fundamental sound stored in the alarm sound RON 60. Reference numeral 81 indicates a left amplifier for controlling a sound reproduced by the alarm sound reproducing circuit 70 to a desired sound level or volume using an acoustic image control circuit 100 and thereafter amplifying it to thereby produce a left component of an output sound.

Reference numeral 82 indicates a right amplifier for controlling the sound reproduced by the alarm sound reproducing circuit 70 to a desired sound level or volume using the acoustic image control circuit 100 and thereafter amplifying it to thereby produce a right component of an output sound. Reference numeral 91 indicates a left speaker for outputting the sound amplified by the left amplifier 81. Reference numeral 92 indicates a right speaker for outputting the sound amplified by the right amplifier 82.

Figure 3:
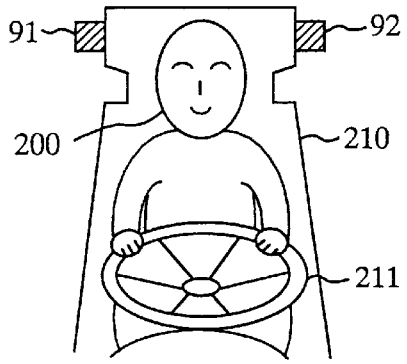
FIG. 3 is a diagram showing the positions of attachment of speakers employed in the first embodiment shown in FIG. 1.

FIG. 3 is a diagram showing one example of the position where each of the left speaker 91 and the right speaker 92 shown in FIG. 2 is mounted within a vehicle. In the drawing, reference numeral 91 indicates a left speaker, reference numeral 92 indicates a right speaker, reference numeral 200 indicates a driver that drives the vehicle, reference numeral 210 indicates a driver's seat, and reference numeral 211 indicates a vehicle's steering wheel. As shown in FIG. 3, the provision of the speakers 91 and 92 in the neighborhood of ears of the driver 200 (in the neighborhood of a headrest) brings about an effect in that an alarm can be produced with a small sound level and it is easy for the driver 200 to hear an alarm sound even when the inside of the vehicle is comparatively noisy.

Muting a car audio set upon outputting the alarm sound is more effective.

A method of outputting an alarm, which is employed in the present embodiment, will next be described. A description will be made of the operation from the determination of the degree of driver's wakefulness to the outputting of an alarm sound when it is determined that the degree of driver's wakefulness has been reduced. First, the opened/closed eyes detecting means 10 detects whether the driver's eyes are in an open or a close state. When the opened/closed eyes detecting means 10 detects that the driver's eyes are closed, the closed-eyes duration measuring means 20 measures the time during which the closed state of eyes lasts.

Further, the characteristic amount calculating means 30 calculates an accumulated or integrated value of the closed-eyes duration corresponding to the amount of characteristic for characterizing the degree of driver's wakefulness, based on the value measured by the closed-eyes duration measuring means 20. Based on the calculated characteristic amount, the determining means 40 makes a decision as to whether the driver is being awakened. When the integrated value per predetermined time (one minute in the present embodiment) is greater than a predetermined quantity (10 seconds in the present embodiment) in this case, the determining means 40 judges the driver as being in the wakefulness-reduced state.

When the dozed-driving preventing apparatus according to the first embodiment gives an alarm or warning as shown in FIG. 2, the alarm sound reproducing circuit 70 receives alarm sound data X(t) on the fundamental sound or tone from the alarm sound ROM 60 and starts to reproduce the fundamental sound X(t) so that it is outputted to the left amplifier 81 and the right amplifier 82. On the other hand, the acoustic image control circuit 100 outputs volume control signals Vl(t) and Vr(t) to the left amplifier 81 and the right amplifier 82.

Further, the left amplifier 81 inputs or receives therein the fundamental sound X(t) outputted from the alarm sound reproducing circuit 70 and the volume control signal Vl(t) outputted from the acoustic image control circuit 100 to calculate an alarm sound Yl(t) expressed by the following equation (1) from these. Thereafter, the left amplifier 81 outputs the result of calculation to the left speaker 91. Moreover, the right amplifier 82 receives the fundamental sound X(t) outputted from the alarm sound reproducing circuit 70 and the volume control signal Vr(t) outputted from the acoustic image control circuit 100 to calculate an alarm sound Yr(t) expressed by the following equation (2) from these. Thereafter, the right amplifier 82 outputs the result of calculation to the right speaker 92.

$$Yl(t)=X(t)Vl(t) \tag{1}$$

$$Yr(t)=X(t)Vr(t) \tag{2}$$

Further, the alarm sound Yl(t) and the alarm sound Yr(t) are outputted from the left speaker 91 and the right speaker 92 respectively.

Examples of the alarm sounds Yl(t) and Yr(t) outputted from the left and right speakers 91 and 92 will next be explained.

In general, a human being recognizes the direction and position of a sound source from the difference in pressure between the sounds that reach the left and right ears thereof and a delay in time between the sounds (phase difference). Therefore, sounds with a predetermined time delay and a sound difference may be outputted from the left and right speakers to allow the human being to obtain predetermined acoustic images (such as the direction and position of the sound source, which have been recognized by the human being) through stereo speakers or the like. It has also been reported that an accurate acoustic image can be obtained by a system using a larger number of speakers.

Further, an acoustic image can be easily obtained even when the difference in pressure is simply provided between the sounds outputted from the left and right speakers without making the time delay. When, for example, the same fundamental sound or sound is outputted from the left and right speakers and the balance between the left and right sound pressures is varied, the direction of the acoustic image can be changed according to the balance therebetween.

Figure 4A:
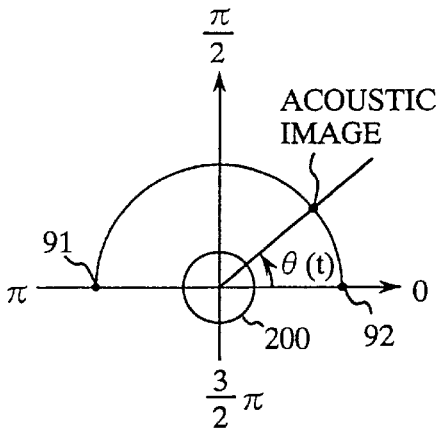
FIGS. 4(*a*) and 4(*b*) are diagrams for describing the movement of acoustic images employed in the first embodiment shown in FIG. 1.
Figure 4B:
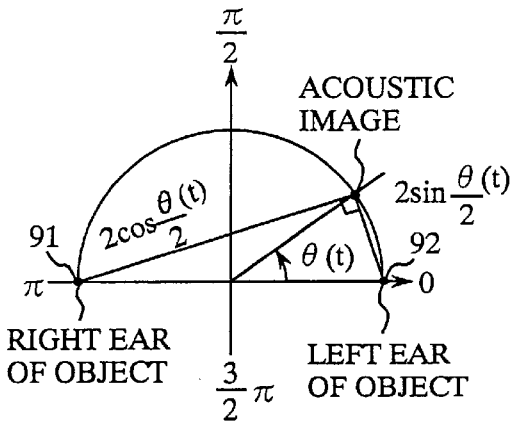

A method of producing an alarm sound whose acoustic image moves on a semi-circumference with the driver 200 as the center as shown in FIG. 4(*a*), will be described below. For simplicity of illustration, a description will first be made of a case in which the position of each speaker is sufficiently near the ears and an acoustic image moves on a semi-circumference that joins or couples the left and right speakers to each other, as shown in FIG. 4(*b*). Incidentally, the drivers 200 [shown] in FIGS. 4(*a*) and 4(*b*) will be placed or faced in the direction of 37T/2 in FIGS. 4(*a*) and 4(*b*)

If the volume control signals Vl(t) and Vr(t) outputted from the acoustic control circuit 100 are first set as the following equation (3) under the alarm sounds Yl(t) and Yr(t) that meet the equations (1) and (2), then the volume of the acoustic image of the fundamental sound in each alarm sounds can be rendered constant.

$$\{(Vl(t)^2)+(Vr(t)^2)\}^{1/2}=1 \tag{3}$$

When the distance between the driver 200 and either the left speaker 91 or the right speaker 92 is set as 1 as shown in FIGS. 4(*a*) and 4(*b*), the distance between the acoustic image existing at an angle &(t) and the left speaker 91 is expressed as follows:

$$2\cos(\theta(t)/2)$$

Further, the distance between the acoustic image and the right speaker 92 is expressed as follows:

$$2\sin(\theta(t)/2)$$

Now consider the relationship in which the distance between the acoustic image and each speaker is inversely proportional to the volume outputted from each speaker. If, for example, the values of the volume control signals Vl(t) and Vr(t) are expressed as the following equations (4) and (5) when it is desired to produce or create the acoustic images in the θ(t) directions shown in FIGS. 4(*a*) and 4(*b*), $$Vl(t)=\sin(\theta(t)/2) \tag{4}$$

$$Vr(t)=\cos(\theta(t)/2) \tag{5}$$

the driver 200 is able to hear the acoustic image so that it exists in the θ(t) direction behind the driver 200.

Further, when the θ(t) is set as the following equation (6), for example, an acoustic image in which the angle θ(t) moves from 0 to π at a constant speed can be obtained.

$$\theta(t)=(\pi/T)t \tag{6}$$

where T: time necessary for θ(t) to move from 0 to π

The above description has been made of the case in which the position of each speaker is so close to the ears and the acoustic image moves on the semi-circumference that couples the left and right speakers to each other, as shown in FIG. 4(*b*). However, the same sound as described above may be outputted from the respective speakers even in the case where an alarm sound whose acoustic image moves on the semi-circumference with the driver 200 as the center is produced as shown in FIG. 4(*a*). Since, in this case, the speakers are respectively separated from the positions of the ears and no consideration is given to the phase difference in the above description, the acoustic image is not produced as given by the calculative expressions described above and an error occurs somewhat.

If the following equation (7) is used in place of 20 the equation (3), $$\{Vl(t)^2)+(Vr(t)^2)\}^{1/2}=r(t) \tag{7}$$

the distance between the driver 200 for the acoustic image of the fundamental sound in the alarm sound and the acoustic image can be varied with time and hence the position of the acoustic image shifted or displaced according to the values of Vl(t), Vr(t) and r(t) can be set arbitrarily.

Thus, the change of Vl(t) and Vr(t) with time allows the movement of an acoustic image of an outputted alarm.

In the present embodiment, the acoustic image of the fundamental sound is shifted by controlling the volume of the outputted alarm sound. It is however needless to say that this is not limited to the control of the volume and the difference in phase between the alarm sound outputted from the left amplifier and the alarm sound outputted from the right amplifier may be controlled. In this case, an accurate acoustic image can be obtained.

In the first embodiment, since the alarm sound whose acoustic image moves, is outputted, an alarm sound, which is different or large from the conventional alarm sound and provides a mental variation, can be outputted to the driver, so that the driver can be prevented long from dozing off at the wheel.

In the first embodiment, the alarm sound whose acoustic image moves from side to side at the constant speed, is outputted. However, the present invention is not limited particularly to this. By modifying the equation (6), such an alarm sound that an acoustic image moves in an arbitrary direction at an arbitrary speed, can be outputted.

Second Embodiment

Figure 5:
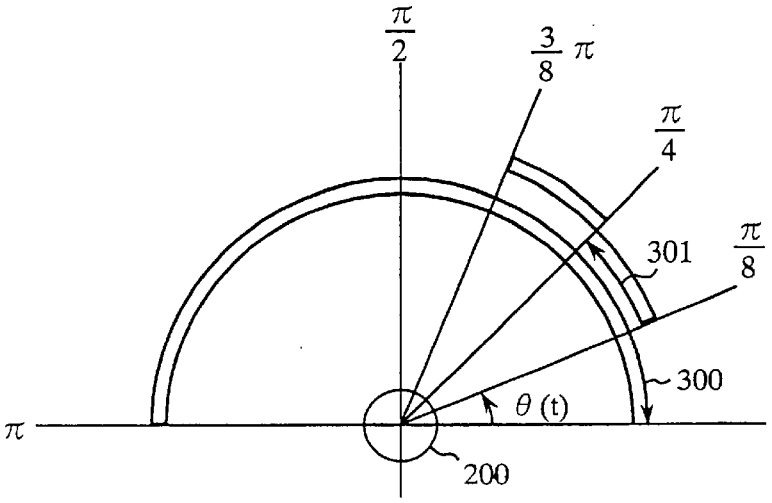
FIG. 5 is a diagram for describing the movement of acoustic images employed in a second embodiment.

FIG. 5 is a diagram showing the movement of acoustic images of transfer alarm sounds employed in a second embodiment of the present invention. In the drawing, reference numeral 300 indicates a locus 1 of a transfer sound and reference numeral 301 indicates a locus 2 of a transfer sound, which is different from the locus 1. In the first embodiment, the method of outputting the alarm sound having one acoustic image for the fundamental sound or sound has been described. In the present embodiment, however, a method of outputting alarm sounds or sounds having acoustic images for a plurality of fundamental sounds will be described.

A plurality of fundamental sounds are first required to output the alarm sounds having the acoustic images for the plurality of fundamental sounds. Therefore, a plurality of fundamental sounds are stored in the alarm sound ROM 60 although one fundamental sound X(t) has been stored in the alarm sound ROM 60 in the first embodiment. For simplicity of illustration, the number of the fundamental sounds is set to two of X1(t) and X2(t), for example.

When it is desired to output such alarm sounds that two acoustic images move, for example, Yl(t) and Yr(t) are set so as to meet the following equations (8) and (9):

$$Yl(t)=X1(t)\sin(\theta1(t)/2)+X2(t)\sin(\theta2(t)/2) \tag{8}$$

$$Yr(t)=X1(t)\cos(\theta1(t)/2)+X2(t)\cos(\theta1(t)/2) \tag{9}$$

Further, if they are set so as to meet the following equations, the alarm sounds having the two acoustic images that move along paths of the loci 1 and 2 shown in FIG. 5 can be output so that a greater mental change can be given to the driver.

$$\theta1(t)=\pi/T1t \tag{10}$$

$$\theta2(t)=\pi/4+\pi/8\sin(\pi t/T2) \tag{11}$$

where T1: time necessary for the acoustic image to move on 5 the locus 1 from 0 to π

T2: time necessary for the acoustic image to move on the locus 2 from π/4, 3π/8 to π/4

Incidentally, alarm sounds in which acoustic images move in arbitrary directions at arbitrary speeds, can be outputted by modifying the equations (10) and (11).

In the first and second embodiments, the driver is able to hear the alarm sounds so that the acoustic images thereof move from side to side behind the driver because the alarm sounds are outputted from the two speakers provided on both sides of the driver. However, no particular limitations are imposed on this. Alarm sounds having acoustic images that move around the driver inclusive of the front of the driver, can be generated by providing speakers forward or rearward of the driver.

Further, alarm sounds audible so that acoustic images move upwardly and downwardly relative to the driver, can be produced by providing speakers above and below the driver.

In the second embodiment, a greater mental change can be given to the driver as compared with the transfer alarm sound having the shifted single acoustic image since the alarm is produced as described above by such transfer alarm sounds that the plurality of acoustic images move. Further, a reduction in mental change with respect to the alarm sounds due to driver's habituation can be controlled so that the driver can be prevented for a long time from dozing.

Third Embodiment

Figure 6:
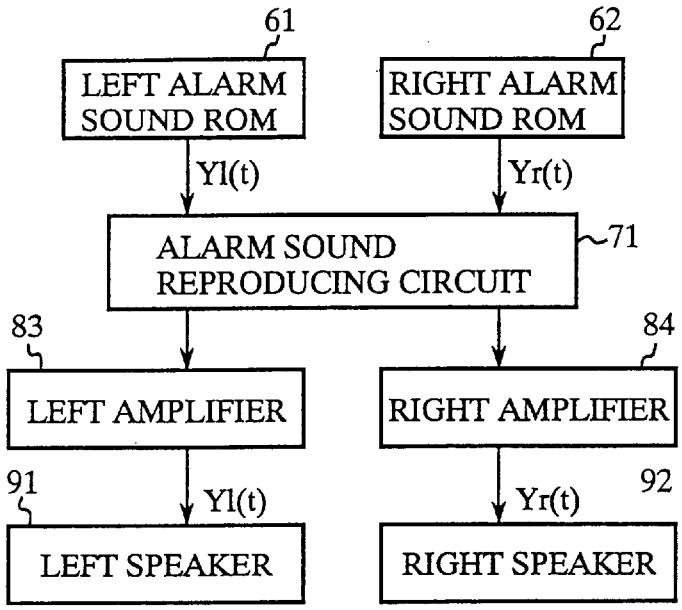
FIG. 6 is a block diagram illustrating a transfer sound warning means employed in a third embodiment.

FIG. 6 is a block diagram showing a transfer sound warning means employed in a third embodiment of the present invention, which corresponds to a block diagram showing one example of the structure of the transfer sound warning means 51 shown in FIG. 1. In the drawing, reference numeral 61 indicates a left alarm sound ROM in which left component data on such an alarm sound that an acoustic image for the fundamental sound or sound moves, has been stored. Reference numeral 62 indicates a right alarm sound ROM in which right component data on such an alarm sound that the acoustic image for the fundamental sound moves, has been stored. For example, left and right component data about transfer alarm sound having time lengths ranging from about 15 to 30 seconds have been stored in the left alarm sound ROM 61 and the right alarm sound ROM 62 respectively.

Reference numeral 71 indicates an alarm sound reproducing circuit for reproducing the alarm sounds stored in the left and right alarm sound ROMs 61 and 62. Reference numeral 83 indicates a left amplifier for amplifying the sound reproduced by the alarm sound reproducing circuit 71. Reference numeral 84 indicates a right amplifier for amplifying the sound reproduced by the alarm sound reproducing circuit 71. Reference numeral 91 indicates a left speaker for outputting the reproduced sound amplified by the left amplifier 83. Reference numeral 92 indicates a right speaker for outputting the reproduced sound amplified by the right amplifier 84. Incidentally, the speakers 91 and 92 will be provided in the neighborhood of the driver's ears (near a headrest) in a manner similar to the first embodiment.

A method of outputting an alarm, which is employed in the present embodiment, will next be described. Since the operation from the determination of the degree of driver's wakefulness to the outputting of an alarm sound when it is determined that the degree of driver's wakefulness has been reduced, is the same as in the first embodiment, its description will be omitted.

When the driver dozing preventing apparatus according to the third embodiment outputs an alarm sound as shown in FIG. 6, the alarm sound reproducing circuit 71 receives the alarm sound stored in the left alarm sound ROM 61 and the alarm sound stored in the right alarm sound ROM 62 therein and starts to reproduce the alarm sound Yl(t) and Yr(t) so that Yl(t) is outputted to the left amplifier 83 and Yr(t) is outputted to the right amplifier 84.

Further, the left amplifier 83 amplifies the sound Yl(t) reproduced by the alarm sound reproducing circuit 70 and the right amplifier 84 amplifies the sound Yr(t) reproduced in the same manner as described above. Next, the left speaker 91 and the right speaker 92 output the reproduced sounds Yl(t) and Yr(t) amplified by the left amplifier 83 and the right amplifier 84, respectively.

While the alarm sounds Yl(t) and Yr(t) in which the acoustic images of the fundamental sounds move, are calculated from the fundamental sound stored in the alarm sound ROM 60 and the control signal outputted from the acoustic image control circuit 10, as shown in FIG. 2 in the first embodiment, the data about the alarm sounds Yl(t) and Yr(t) in which the acoustic images of the fundamental sounds move, have been stored in the left alarm sound ROM 61 and the right alarm sound ROM 62 respectively in advance in the third embodiment. Thereafter, the control signal outputted from the acoustic image control circuit 100, and the like become unnecessary and the alarm sounds whose acoustic images move, can be outputted by simply reproducing the alarm sound data stored in the left alarm sound ROM 61 and the right alarm sound ROM 62 with the alarm sound reproducing circuit 71.

Even in the method of outputting the alarm, which has been described in the present embodiment, the same alarm sounds as those described in the first and second embodiments can be outputted by storing the alarm sounds Yl(t) and Yr(t) described in the first and second embodiments in the left alarm sound ROM 61 and the right alarm sound ROM 62 respectively.

Although the left alarm sound ROM and the right alarm sound ROM have been described in parts in the present embodiment, the present invention is not limited to this in particular. It is needless to say that the data to be stored in the left alarm sound ROM and the right alarm sound ROM may be stored in one alarm sound ROM.

Since the data about the alarm sounds outputted from the speakers are stored in their corresponding alarm sound ROMs in the present embodiment, the acoustic image control circuit shown in FIG. 2 in the first embodiment becomes unnecessary and the alarm sounds whose acoustic images move, can be outputted easier.

Fourth Embodiment

Figure 7:
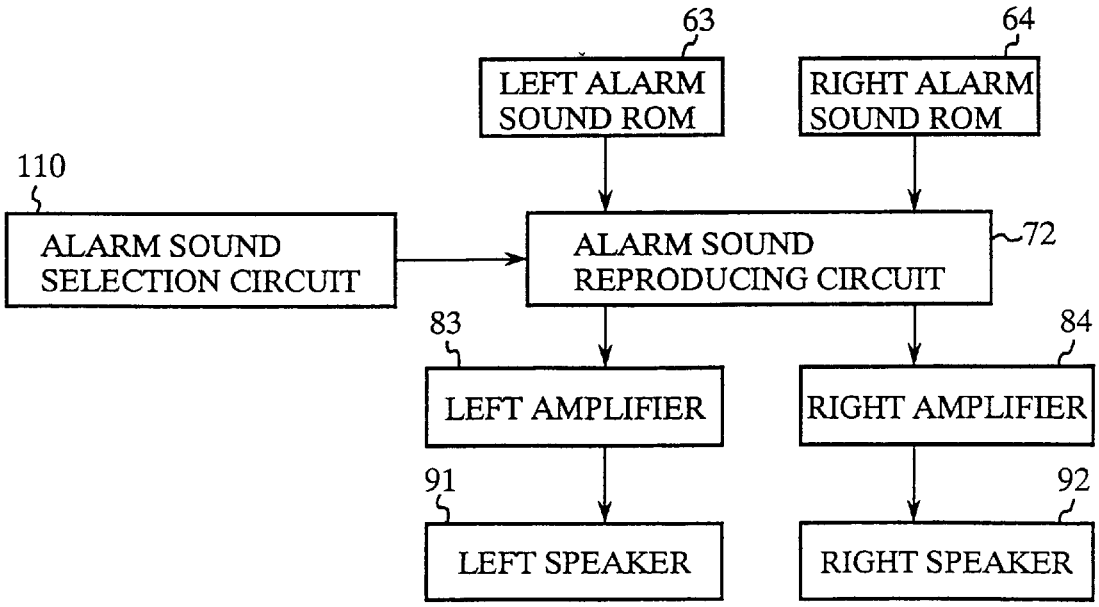
FIG. 7 is a block diagram showing a transfer sound warning means employed in a fourth embodiment.

FIG. 7 is a block diagram showing a transfer sound warning means employed in a fourth embodiment of the present invention, which corresponds to a block diagram illustrating one example of the structure of the transfer sound warning means 51 shown in FIG. 1. In the drawing, reference numeral 63 indicates a left alarm sound ROM, reference numeral 64 indicates a right alarm sound ROM. A plurality of alarm sound candidates such as left component data (Y1l(t), Y2l(t)) and right component data (Y1r(t), Y2r(t)) about transfer alarm sounds (two types of Y1(t), Y2(t)) having time lengths ranging from about 15 to 30 seconds, for example, are stored in the left alarm sound ROM 63 and the right alarm sound ROM 64 respectively. At this time, the acoustic images of Y1(t) and Y2(t) will be defined as being different in transfer mode from each other as in the case where Y1(t) is an alarm sound having an acoustic image shifted from the right to the left and Y2(t) is an alarm sound shifted from the left to the right.

Reference numeral 72 indicates an alarm sound reproducing circuit, reference numeral 83 indicates a left amplifier, reference numeral 84 indicates a right amplifier, reference numeral 91 indicates a left speaker, reference numeral 92 indicates a right speaker, and reference numeral 110 indicates an alarm sound selection circuit for selecting an alarm sound to be outputted as an alarm from a plurality of alarm sound candidates.

Now consider that speakers are provided in the vicinity of ears of a driver (in the vicinity of a headrest) in a manner similar to the first and second embodiments.

A method of outputting an alarm, which is employed in the present embodiment, will next be described. Since the operation from the determination of the degree of driver's wakefulness to the outputting of an alarm sound when it is determined that the degree of driver's wakefulness has been reduced, is the same as in the first embodiment, its description will be omitted.

When the dozed-driving preventing apparatus according to the fourth embodiment produces an alarm as shown in FIG. 7, the alarm sound selection circuit 110 selects either one of the alarm sounds (Y1(t), Y2(t)) stored in the alarm sound ROMs 63 and 64. For example, the alarm sound longer from the other in time that elapsed from the final selection of the alarm sound, is selected from the alarm sounds Y1(t) and Y2(t).

Next, the alarm sound reproducing circuit 72 receives data about the alarm sound selected by the alarm sound selection circuit 110 from the left alarm sound ROM 63 and the right alarm sound ROM 64 and starts to reproduce voices. When the alarm sound selection circuit 110 selects Y1(t), for example, the alarm sound reproducing circuit 72 receives Y1l(t) and Y1r(t) from the left alarm sound ROM 63 and the right alarm sound ROM 64 and starts to reproduce voices. The reproduced voices are outputted from the left speaker 91 and the right speaker 92 through the left amplifier 83 and the right amplifier 84.

In the fourth embodiment, the alarm sounds stored in the alarm sound ROM are defined as two types but not limited to these in particular. With the increase in type of the alarm sound, a mental change can be given to the driver.

Although the fourth embodiment has described the 15 case in which the alarm sound selection circuit selects the alarm sound longer than the other in time that elapsed from the final selection of the alarm sound from the alarm sounds Y1(t) and Y2(t), no particular limitations are imposed on this. The alarm sound may be selected on a random basis, for example.

In the fourth embodiment, the two types of alarm sounds, i.e., the alarm sound whose acoustic image moves from the right to the left and the alarm sound whose acoustic image moves from the left to the right, have been utilized. However, no limitations are imposed on this. A plurality of types of alarm sounds may be used as in the case of an alarm sound whose acoustic image moves, an alarm sound whose acoustic image is not shifted, etc.

Fifth Embodiment

Figure 8:
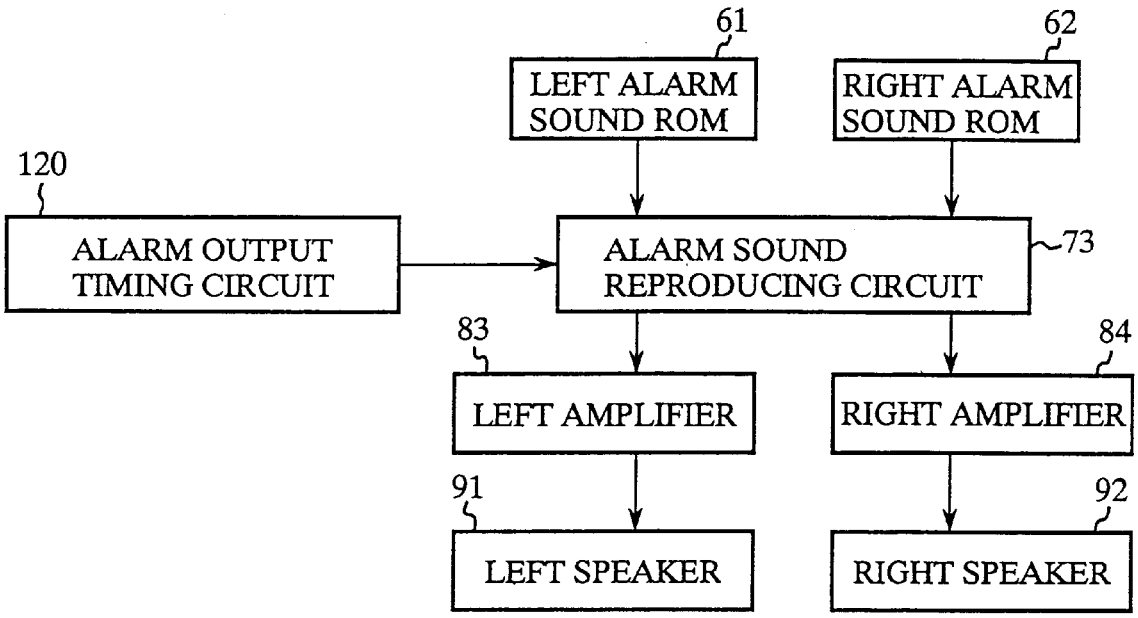
FIG. 8 is a block diagram depicting a transfer sound warning means employed in a fifth embodiment.
Figure 14:
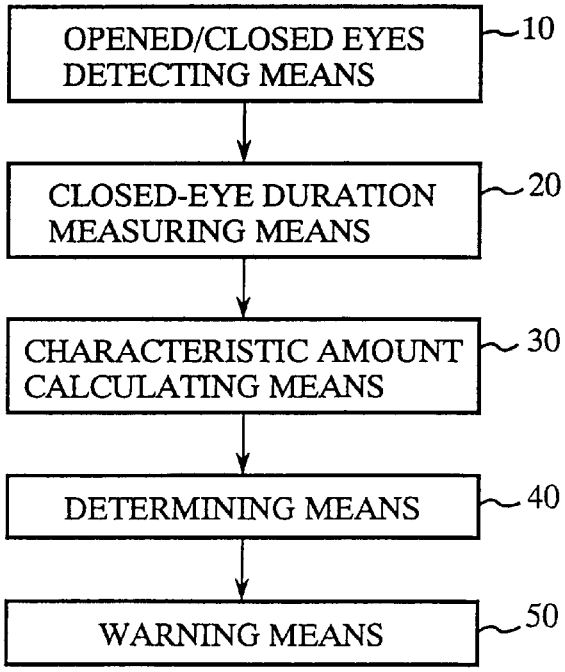
FIG.14(PRIOR ART)
FIG. 14 is a block diagram showing a conventional dozed-driving preventing apparatus.
Figure 9A:
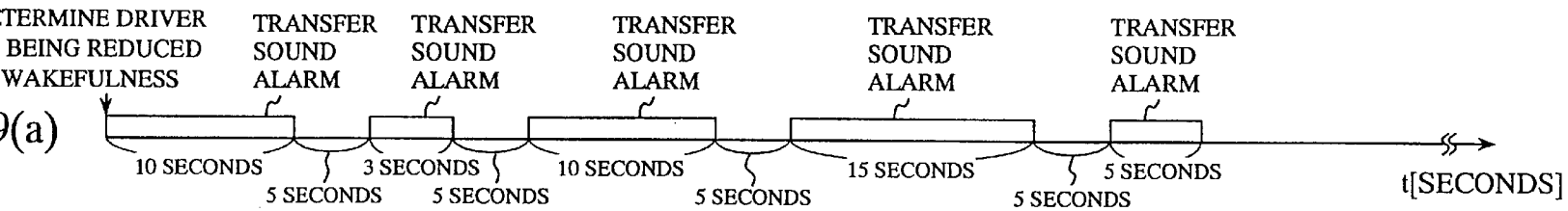
FIGS. 9(*a*) through 9(*d*) are respectively timing charts for explaining alarm sound outputs employed in the fifth embodiments.
Figure 9B:
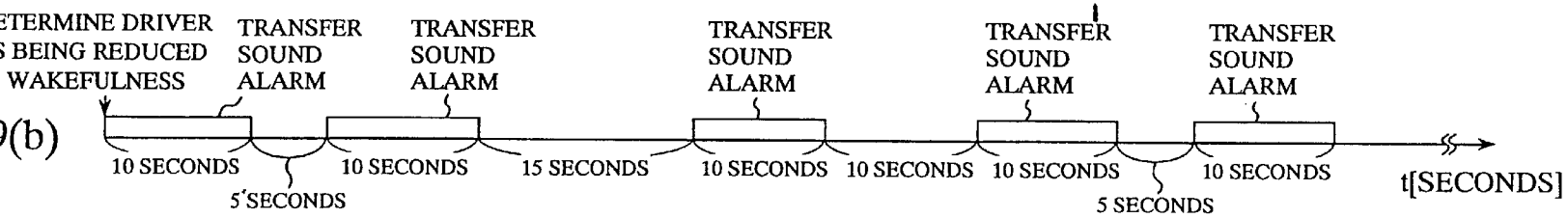
Figure 9C:
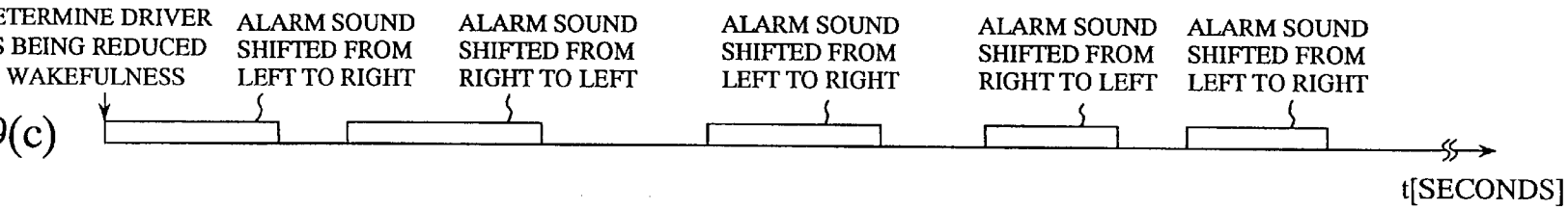
Figure 9D:
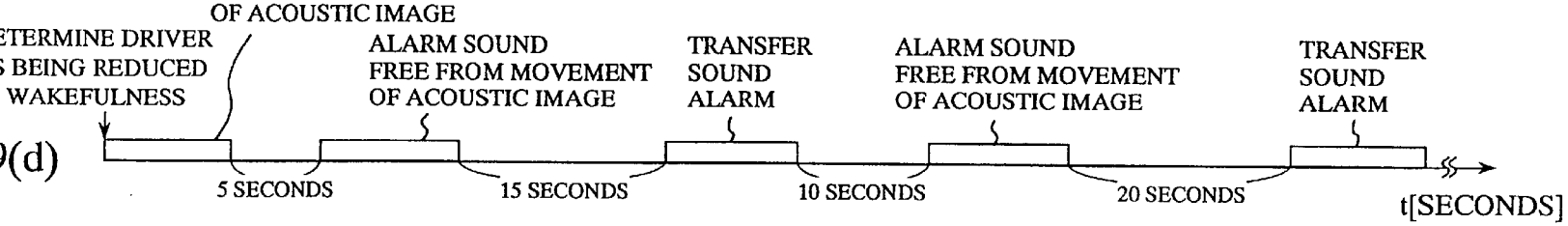

FIG. 8 is a block diagram showing a transfer sound warning means employed in a fifth embodiment of the present invention, which corresponds to a block diagram illustrating one example of the structure of the transfer sound warning means 51 shown in FIG. 1. In the drawing, reference numeral 61 indicates a left alarm sound ROM, reference numeral 62 indicates a right alarm sound ROM. Left and right component data about transfer sounds having time lengths ranging from about 15 to 30 seconds, for example, are stored in the left alarm sound ROM 61 and the right alarm sound ROM 62 respectively.

Reference numeral 73 indicates an alarm sound reproducing circuit, reference numeral 83 indicates a left amplifier, reference numeral 84 indicates a right amplifier, reference numeral 91 indicates a left speaker, reference numeral 92 indicates a right speaker, and reference numeral 120 indicates an alarm output timing circuit for controlling timing provided to output an alarm. The alarm output timing circuit 120 outputs an alarm output timing signal again after random time intervals ranging from about 5 seconds to 60 seconds have elapsed since the output of the alarm, for example.

Now consider that the speakers 91 and 92 are provided in the neighborhood of driver's ears (in the vicinity of a headrest) in a manner similar to the first embodiment.

A method of sounding an alarm, which is employed in the present embodiment, will next be described. Since the operation from the determination of the degree of driver's wakefulness to the outputting of an alarm sound when it is determined that the degree of driver's wakefulness has been reduced, is the same as in the first embodiment, its description will be omitted.

When the driver dozing preventing apparatus according to the fifth embodiment produces an alarm as shown in FIG. 8, the alarm sound reproducing circuit 73 first receives the alarm sound data from the left alarm sound ROM 61 and the right alarm sound ROM 62 and starts to reproduce voices. The reproduced alarm sounds are outputted from the left speaker 91 and the right speaker 92 through the left amplifier 83 and the right amplifier 84.

After the completion of the output of the alarm sounds, the alarm output timing circuit 120 outputs an alarm output timing signal to the alarm sound reproducing circuit 73 again after the elapse of random time intervals ranging from 5 seconds to 60 seconds. Upon receipt of the alarm output timing signal, the alarm sound reproducing circuit 73 receives the alarm sound data from the left alarm sound ROM 61 and the right alarm sound RON 62 and starts to reproduce voices.

In the fifth embodiment, the alarm sound stored in the alarm sound ROM is set to one but not limited to this. It is needless to say that the plurality of types of alarm sounds may be outputted as described in the fourth embodiment or the alarm output may be carried out in accordance with the method described in the first embodiment.

FIGS. 9(*a*) through 9(*d*) are respectively diagrams showing timing charts for describing alarm outputs employed in the fifth embodiment. FIG. 9(*a*) is a timing chart in which time intervals required to output the individual alarms are made different from each other when the alarm is outputted plural times. FIG. 9(*b*) is a timing chart in which time intervals between adjacent respective alarm outputs are made different from each other when an alarm is outputted plural times. FIG. 9(*c*) is a timing chart in which transfer alarm sounds of respective alarm outputs are made different in type from each other when the alarm is outputted plural times. FIG. 9(*d*) is a timing chart in which alarm sounds of respective alarm outputs are made different in type from each other when the alarm is outputted plural times.

According to the timing chart shown in FIG. 9(*a*), an alarm sound is first outputted for ten seconds after it is determined that the degree of driver's wakefulness has been reduced. Thereafter, an alarm sound is outputted for three seconds this time after the elapse of several seconds. Similarly, the time intervals required to output the subsequent alarm sounds are varied.

Thus, since the driver cannot expect the period or cycle of each alarm output due to the change in time required to output each alarm sound, a greater mental change can be applied to the driver so that the driver can be prevented for hours from dozing.

According to the timing chart shown in FIG. 9(*b*), an alarm sound is first outputted after it is determined that the degree of driver's wakefulness has been reduced. Thereafter, the next alarm sound is outputted after 5 seconds since the alarm sound has been outputted. Further, an alarm sound is outputted after 15 seconds since the alarm sound has been outputted. Similarly, the time intervals between the subsequent alarm sounds are varied.

Thus, since the driver cannot expect timing provided to output each alarm due to the change in time between the respective alarm sounds, a greater mental change can be given to the driver so that the driver can be prevented for hours from dozing.

According to the timing chart shown in FIG. 9(*c*), an alarm sound whose acoustic image moves from the left to the right, is first outputted after it is determined that the degree of driver's wakefulness has been reduced. Thereafter, an alarm sound whose acoustic image moves from the right to the left, is outputted this time after the elapse of several seconds. Similarly, the direction of movement or transfer of an acoustic image in each alarm sound to be outputted subsequently, the speed of transfer thereof, etc. are varied.

Thus, since the driver is not accustomed to the alarm outputs by varying the transfer patterns of the acoustic images in the respective alarm sounds, the driver can be prevented for hours from dozing.

If the type of alarm sound shown in FIG. 9(*c*) is outputted inclusive of general alarm sounds whose acoustic images do not move, as shown in FIG. 9(*d*), then a greater mental change can be given to the driver, so that the driver can be prevented for hours from dozing.

The present embodiment has described the case in which the time intervals required to output the respective alarm sounds, the time intervals between the respective alarm sounds and the type of each alarm sound are individually varied for simplicity of illustration. However, if these are utilized in combination, then the greater mental change can be given to the driver.

Sixth Embodiment

Figure 10A:
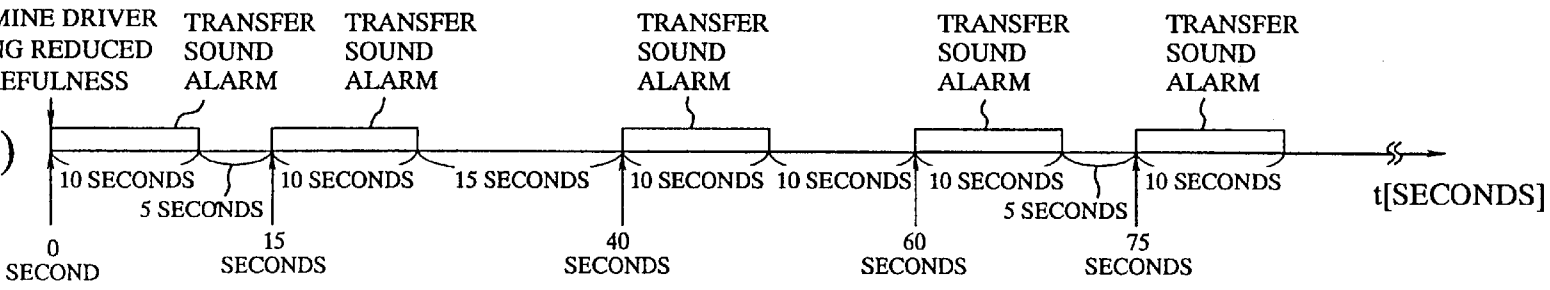
FIGS. 10(*a*) through 10(*b*) are respectively timing charts for describing alarm sound outputs employed in a sixth embodiment.
Figure 10B:
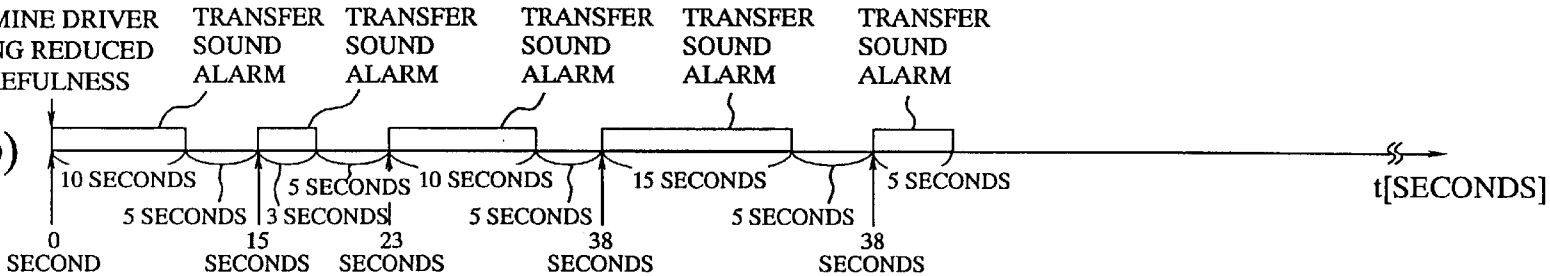

FIGS. 10(*a*) and 10(*b*) are respectively diagrams showing timing charts for describing alarm outputs employed in a sixth embodiment of the present invention, wherein FIG. 10(*a*) is a timing chart in which time intervals between the respective alarm outputs are made different from each other when an alarm is outputted plural times, and FIG. 10(*b*) is a timing chart in which time intervals required to output respective alarms are made different from each other when an alarm is outputted plural times.

According to the timing chart shown in FIG. 10(*a*), an alarm sound is first outputted for 10 seconds, for example immediately after it is determined that the degree of driver's wakefulness has been reduced. Next, an alarm sound is outputted for 10 seconds, for example, 15 seconds later after it is determined that the degree of driver's wakefulness has been reduced. Similarly, an alarm sound is outputted after the elapse of a predetermined time interval since it is determined that the degree of driver's wakefulness has been reduced.

The same alarm outputs as those shown in FIG. 9(*b*) in the fifth embodiment can be produced by outputting the alarm sounds in this way.

While FIG. 9(*b*) in the fifth embodiment shows the timing chart in which the time interval between outputting the alarm sound and outputting the next alarm sound is determined and the next alarm sound is outputted after the time interval determined subsequent to the output of the alarm sound has elapsed, the present embodiment shows the case in which the alarm sound is outputted based on the time at which it is determined that the degree of driver's wakefulness has been reduced. Therefore, each alarm sound based on the timing chart shown in FIG. 10(*a*) can be outputted easier.

According to the timing chart shown in FIG. 10(*b*), 20 an alarm sound is first outputted for 10 seconds, for example immediately after it is determined that the degree of driver's wakefulness has been reduced. Next, an alarm sound is outputted for 3 seconds, for example after the elapse of 15 seconds since the judgement of the degree of driver's wakefulness as being reduced. Similarly, alarm sounds different in output time from each other are outputted after the elapse of predetermined time intervals since the judgement of the degree of driver's wakefulness as being reduced.

The same alarm outputs as those shown in FIG. 9(*a*) in the fifth embodiment can be produced by outputting the alarm sounds in this way.

While FIG. 9(*a*) in the fifth embodiment shows the timing chart in which the time interval between outputting the alarm sound and outputting the next alarm sound is determined and the next alarm sound is outputted after the time interval determined subsequent to the output of the alarm sound has elapsed, the present embodiment shows the case in which the alarm sound is outputted based on the time at which it is determined that the degree of driver's wakefulness has been reduced. Therefore, each alarm sound based on the timing chart shown in FIG. 10(*b*) can be outputted easier.

The present embodiment has described the case in which the time intervals required to output the respective alarm sounds and the time intervals between the respective alarm sounds are varied. However, even when the type of each alarm sound described in the fifth embodiment is varied, it can be done in the same manner as described above.

According to the present embodiment, since the method of outputting each of the alarm sounds is controlled based on the time at which it is determined that the degree of driver's wakefulness has been reduced, these alarm sounds can be outputted easier.

Seventh Embodiment

Figure 11:
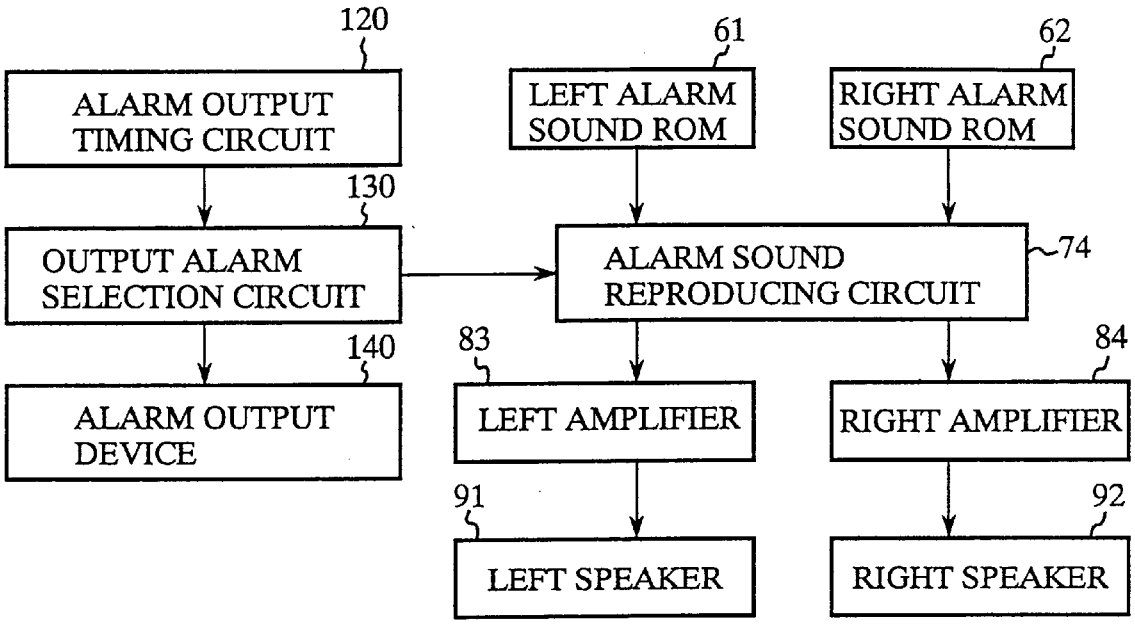
FIG. 11 is a block diagram illustrating a transfer sound warning means employed in a seventh embodiment.

FIG. 11 is a block diagram showing a transfer sound warning means employed in a seventh embodiment of the present invention, which corresponds to a block diagram illustrating one example of the structure of the transfer sound warning means 51 shown in FIG. 1. In the drawing, reference numeral 61 indicates a left alarm sound ROM, and reference numeral 62 indicates a right alarm sound ROM. Left and right component data about transfer alarm sounds having time lengths ranging from about 15 to 30 seconds, for example, are stored in the left alarm sound ROM 61 and the right alarm sound ROM 62 respectively.

Figure 12:
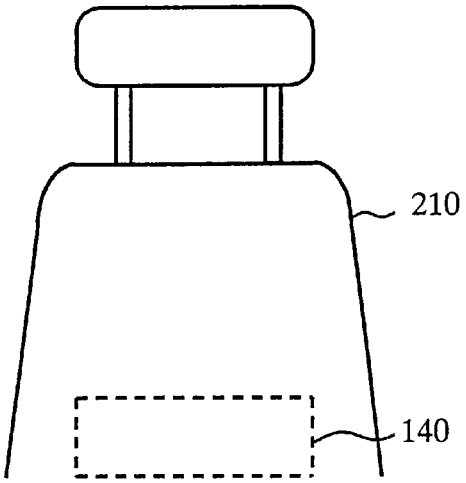
FIG. 12 is a diagram showing the position of attachment of a vibration device employed in the seventh embodiment.

Reference numeral 74 indicates an alarm sound reproducing circuit, reference numeral 83 indicates a left amplifier, reference numeral 84 indicates a right amplifier, reference numeral 91 indicates a left speaker, reference numeral 92 indicates a right speaker, and reference numeral 120 indicates an alarm output timing circuit for outputting an alarm output timing signal after random time intervals ranging from about 5 seconds to 60 seconds have elapsed since each alarm output is done as described in the fifth embodiment. Reference numeral 130 indicates an output alarm selection circuit for selecting whether an alarm should be done, using either one of an alarm output device and an alarm sound upon warning. Reference numeral 140 indicates an alarm output device such as a vibrator or the like, which is provided at a driver's seat position shown in FIG. 12, for example, and outputs vibrations to a driver as a doze alarm for, for example, about 15 to 30 seconds as in the case of a massager.

Incidentally, speakers are provided in the vicinity of driver's ears (in the neighborhood of a headrest) in a manner similar to the first embodiment.

A method of outputting alarms, which is employed in the present embodiment, will next be described. Since the operation from the determination of the degree of driver's wakefulness to the outputting of an alarm sound when it is determined that the degree of driver's wakefulness has been reduced, is the same as in the first embodiment, its description will be omitted.

When the alarm is produced by the driver dozing preventing apparatus according to the seventh embodiment as shown in FIG. 11, the alarm sound reproducing circuit 74 receives the alarm sound data from the left alarm sound ROM 61 and the right alarm sound RON 62 and starts to reproduce voices. Next, when the alarm output timing signal is sent to the output alarm selection circuit 130 from the alarm output timing circuit 120, the output alarm selection circuit 130 selects the type of alarm to be outputted. A selecting method at this time is executed so as to select one long in time that elapsed from the final choice, from, for example, selectable choices. When the selected alarm is an alarm sound, for example, the reproduced alarm sounds are outputted from the left and right speakers 91 and 92 through the let and right amplifiers 83 and 84 respectively.

After the output of the alarm by the alarm sounds, the alarm output timing circuit 120 outputs an alarm output timing signal to the output alarm selection circuit 130 again after the elapse of random time intervals ranging from, for example, 5 seconds to 60 seconds since a predetermined time interval has elapsed. Next, when the output alarm selection circuit 130 selects a vibration alarm, the vibrator 140 is activated to output vibrations.

The seventh embodiment has described the case in which the transfer sounds and the alarms using the vibrations are utilized. However, no particular limitations are imposed on this. If, for example, cold air introduced from an air conditioner is blown against a driver or a mentholated odor is blown out in addition to the above, then a physiological change accelerating further wakefulness can be also given to the driver and hence the driver can be prevented for hours from dozing.

Although one long in time that elapsed from the final choice is selected in the seventh embodiment, the present invention is not limited to this. The alarm may be selected on a random basis, for example.

Figure 13:
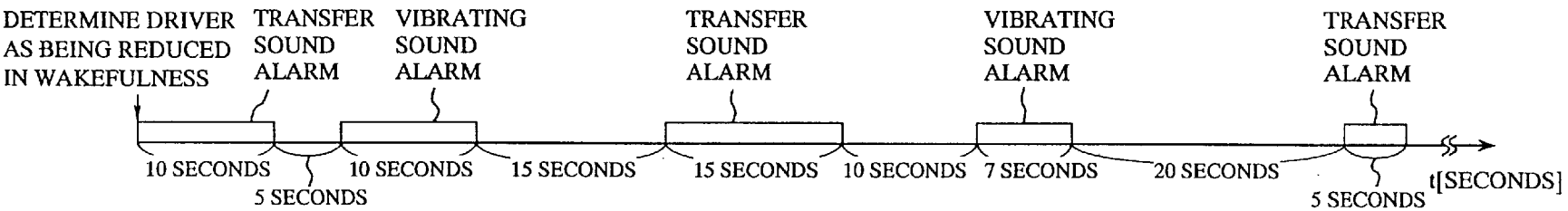
FIG. 13 is a timing chart for describing an alarm sound output employed in the seventh embodiment.

FIG. 13 is a diagram showing a timing chart for describing alarm outputs employed in the seventh embodiment. According to the timing chart shown in FIG. 13, an alarm sound whose acoustic image moves, is first outputted after it is determined that the degree of driver's wakefulness has been reduced. After the elapse of 5 seconds subsequent to its output, a vibration alarm is next outputted. Similarly, the type of the subsequent alarm is changed.

The driver is subjected to the alarms in accordance with different methods by varying the type of each alarm in this way. Thus, since a greater mental change can be given to the driver, the driver can be prevented for hours from dozing.

According to the seventh embodiment, since another alarm such as the vibrations or the like, etc. is used as well as the alarm using only the sound such as the transfer sound or the like whose acoustic image moves, an alarm for giving a greater mental change to the driver can be issued, thus making it possible to prevent the dozing of the driver for hours.

Although the alarm sound to be stored in the alarm sound RON is set to one in the seventh embodiment, no imitations are imposed to this. If a plurality of types of alarm sounds are stored and outputted as in the fourth and fifth embodiments, then a mental change can be further given to the driver.

According to the fifth through seventh embodiments, once it is determined that the driver has been reduced in wakefulness, an intermittent alarm continues until a power source for a doze detector is turned off. However, if a predetermined time has elapsed since it is determined that the degree of driver's wakefulness has been reduced, then an alarm may be stopped using a timer or the like.

According to the fifth through seventh embodiments, once it is determined that the degree of driver's wakefulness has been reduced, the intermittent alarm continues until the power source for the doze detector is turned off. However, if the alarms are stopped or the time interval between the alarms is rendered long when the degree of driver's wakefulness is determined during the continuation of the alarm and the driver is judged to be awakened, then the driver does not feel the alarm irksome when the driver is awakened.

According to the fifth through seventh embodiments as well, once it is judged that the degree of driver's wakefulness has been reduced, the intermittent alarm continues until the power source for the doze detector is turned off. However, a switch capable of making a request for the alarm stop of the driver is provided, and the alarm may be stopped when the switch is turned ON.

In the first through seventh embodiments, the reduction in driver's awakening is determined according to the time for the reduction in the duration of object's closed eyes. However, no particular limitations are imposed on this. It is needless to say that a decision as to whether the driver is dozing, may be performed by another method.

In the first through fifth embodiments, the transfer sound warning means starts warning when the determining means has judged the degree of driver's wakefulness as being reduced. However, a switch corresponding to the alarm output producing means that is able to make an alarm start request from the driver, is provided, and the alarm may be started when the switch is turned ON.

While the preferred embodiments of the present invention have been described above, the description is illustrative only. It should be understood that modifications and changes from these description can be made without departing from the spirit and scope of the following claims.

What is claimed is:

1. A driver dozing preventing apparatus comprising:

means for issuing a doze prevention alarm signal; and means for outputting an alarm sound having a moving acoustic image of a fundamental sound when the alarm signal is issued from said issuing means.

2. A driver dozing preventing apparatus as claimed in claim 1, wherein said issuing means issues the doze prevention alarm signal when a degree of driver's wakefulness has been reduced.

3. A driver dozing preventing apparatus as claimed in claim 1, wherein the alarm sound includes a plurality of moving acoustic images.

4. A driver dozing preventing apparatus as claimed in claim 1, wherein the alarm sound is selected from an available plurality of alarm sounds.

5. A driver dozing preventing apparatus as claimed in claim 4, wherein the alarm sound is selected from an available alarm sound having a first fundamental sound and an available alarm sound having a second fundamental sound different from the first fundamental sound.

6. A driver dozing preventing apparatus as claimed in claim 4, wherein the alarm sound is selected from an available alarm sound having a first transfer mode of an acoustic image and an available alarm sound having a second transfer mode of an acoustic image, which is different from the first transfer mode.

7. A driver dozing preventing apparatus as claimed in claim 1, wherein said outputting means outputs the alarm sound plural times.

8. A driver dozing preventing apparatus as claimed in claim 7, wherein said outputting means outputs a second alarm sound different from a first alarm sound after the first alarm sound has been outputted.

9. A driver dozing preventing apparatus as claimed in claim 8, wherein the first or second alarm sound is an alarm sound having a fixed acoustic image.

10. A driver dozing preventing apparatus as claimed in claim 7, wherein a time interval of a first alarm sound output by said outputting means differs from a time interval of a second alarm sound output by said outputting means.

11. A driver dozing preventing apparatus as claimed in claim 7, wherein time intervals between alarm sounds are different from each other.

12. A driver dozing preventing apparatus as claimed in claim 1, wherein, in response to said alarm signal the apparatus further outputs at least one of vibrations, odors and cold air.

* * * * *